US005769554A

United States Patent [19]

Slocum

[11] Patent Number: 5,769,554

[45] Date of Patent: Jun. 23, 1998

[54] KINEMATIC COUPLING METHOD AND SYSTEM FOR ALIGNING SAND MOLD CORES AND THE LIKE AND OTHER SOFT OBJECTS AND SURFACES

[75] Inventor: Alexander H. Slocum, Bow, N.H.

[73] Assignee: AESOP, Inc., Concord, N.H.

[21] Appl. No.: 694,024

[22] Filed: Aug. 8, 1996

[51] Int. Cl.[6] ..... B22D 33/04; B41B 11/60; F16B 5/02

[52] U.S. Cl. ..... 403/13; 164/137; 249/165; 403/90

[58] Field of Search ..... 164/137, 339; 249/61, 160, 163, 165; 403/13, 84, 90

[56] References Cited

U.S. PATENT DOCUMENTS

| | | | |
|---|---|---|---|
| 628,578 | 7/1899 | Eisele | 164/339 |
| 3,039,157 | 6/1962 | Bobenmyer | 164/339 |
| 4,674,551 | 6/1987 | Kawai et al. | 164/137 X |
| 5,098,432 | 3/1992 | Wagenknecht | 403/90 X |
| 5,253,966 | 10/1993 | Clemens et al. | 249/165 X |

FOREIGN PATENT DOCUMENTS

| | | | |
|---|---|---|---|
| 1002088 | 3/1983 | Russian Federation | 164/137 |

*Primary Examiner*—Anthony Knight
*Attorney, Agent, or Firm*—Rines and Rines

[57] ABSTRACT

The invention embraces the incorporation of kinematic fixturing elements into cores as for the precise casting of components, where typically the cores are much softer than metal, and typically the cores are sacrificial (they are destroyed during the casting process) whereby kinematic coupling grooves are located in each of the to-be-mated surfaces of a pair of core elements, such that when a ball is placed in each of the pairs of grooves, and the elements are brought together, even with coarse axial location of the ball in the grooves, very precise relative location of the two cores is obtained; and then, when a clamping force is applied to the cores, the balls create deformation of the core grooves, and the surfaces on the two cores come together into intimate contact.

18 Claims, 2 Drawing Sheets

KINEMATIC COUPLING METHOD AND SYSTEM FOR ALIGNING SAND MOLD CORES AND THE LIKE AND OTHER SOFT OBJECTS AND SURFACES

The present invention relates to methods of and systems for precisely aligning mold cores as of sand and the like and other soft objects, where it is desired to align such soft objects with a great deal of precision, and then to clamp them together without loss of alignment.

BACKGROUND

Currently, molds, such as those typically used for metal casting and the like, are often made from sand held together with a binder. After hot metal is poured in, its heat burns out the binder as the metal solidifies. The sand is then removed from the casting, even deep internal recesses, by vibration or other methods. The cores are typically made by packing the binder-coated sand around a permanent pattern, often made from wood or aluminum. Many cores may be put together to form a complete mold and may have many complex internal features formed by intermingling of core features. An example would be the cores used to put together an engine block mold, where the cylinder core must be carefully aligned with respect to the outside core. If the cores are too misaligned, then the engine wall thickness will vary too much.

In pending U.S. patent application Ser. No. 08/568,612, filed Dec. 7, 1995 for Flexural Mount Kinematic Couplings and Method, applicant has disclosed the design of specialized systems that utilize combinations of balls and grooves to form deterministic kinematic couplings, especially adapted for systems wherein the mating objects or surfaces are relatively hard, as of metal or the like and come into repeated contact. For applications such as sand mold cores or the like, however, the couplings are often "one shot" systems, and the mating surfaces are relatively soft.

It is to the provision of kinematic coupling techniques particularly tailored to aligning mold cores and other soft objects, accordingly, that the present invention is primarily directed.

OBJECTS OF THE INVENTION

An object of the present invention, accordingly, is to provide a new and improved kinematic coupling method and structure for precisely locating two objects or surfaces with respect to one other, particularly where one or both of the objects is or are soft.

Another object of the invention is to provide an inexpensive and easy to implement means precisely to align sand cores commonly used in metal castings.

Another objective is to provide a means for kinematically locating two soft core surfaces or objects-to-be-mated with respect to one other by using coupling grooves therein kinematically located by hard balls that indent into the cores until the surfaces are in contact Other and further objects will be explained hereinafter and are more fully delineated into the appended claims.

SUMMARY

In summary, from one of its viewpoints, the invention embraces a method of kinematically coupling and clamping together a pair of opposing objects, that comprises, forming opposing sets of grooves in each object; inserting ball elements between corresponding grooves of the objects, the grooves and the ball elements being of significantly different relative hardness; and clamping the objects together to enable deformations at the ball-groove interfaces that cause the objects to translate and come together in intimate planar contact, while maintaining precise kinematic location until contact.

The invention incorporates kinematic fixturing elements into cores for precise casting of components, where typically the cores are much softer than metal, and typically the cores are sacrificial, being destroyed during the casting process, and whereby kinematic coupling grooves are located in each of the core surfaces-to-be-mated of a pair of core elements, such that when a hard ball is placed in each of the pairs of grooves, and the elements are brought together, even with coarse axial location of the ball in the grooves, very precise relative location of the two cores is obtained, such that when a clamping force is applied to the cores, the balls indent into and deform the surfaces of the core elements as they translate and come together into intimate contact.

This is achieved by forming V shaped sets of grooves in the objects, and axially locating balls in the sets of the vees, and then placing the grooves of the mating object against the intermediate balls such that when clamping pressure is applied, the balls deform the soft material and allow the soft components to come together into intimate precise contact.

Preferred and best mode embodiments and designs are later detailed.

DRAWINGS

The invention will now be described with reference to the accompanying drawing in which:

FIG. 1 is a cutaway side view of a two-piece sand mold, where the mold parts contain the kinematic coupling grooves of the invention, showing how the hard ball located in the grooves is pierced by a clamping bolt;

FIGS. 2*a* and 2*b* are a cutaway close-up side view of two parts of a mold, each with a groove and clamp-through hole and a ball to position the parts with respect to one another, illustrating, respectively, the ball in the groove before the parts are clamped together, and the ball indention into the grooves after the parts are clamped together, FIG. 3 shows a ball with a hole through it that is typically useful in this type of coupling;

PREFERRED EMBODIMENT(S) OF THE INVENTION

Figure 1:
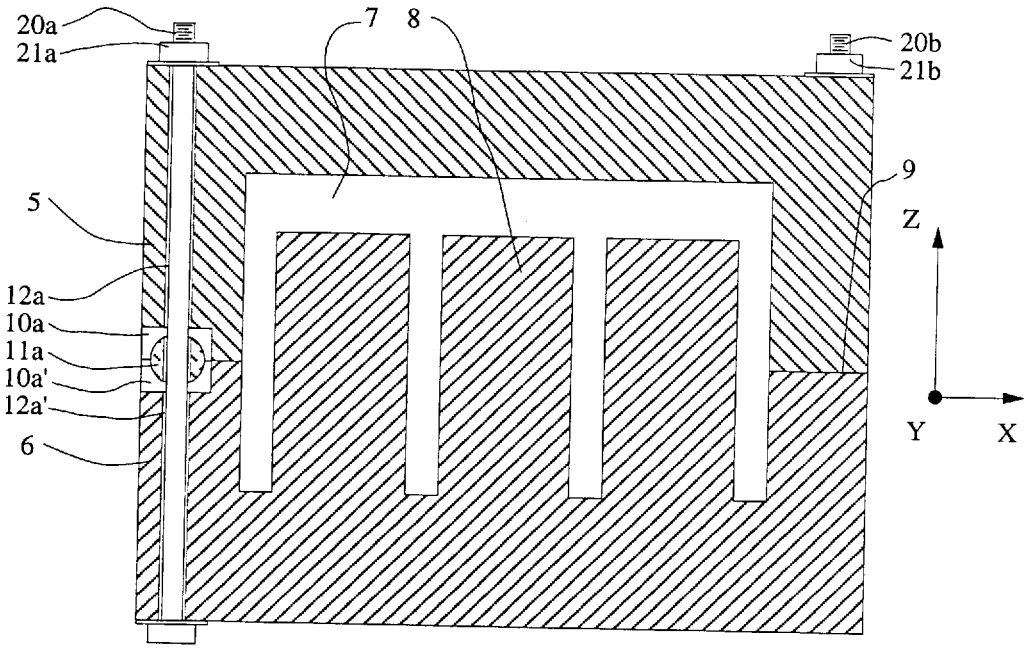

FIG. 1 shows a cutaway view of a molten metal mold for a part to be cast, where the upper half of the mold 5 needs to be precisely positioned with respect to the lower half 6, while maintaining a tightly clamped interface 9 to prevent the molten metal from leaking out of the mold. In this case, the lower half 6 has cores 8 that project into the cavity 7 of the upper half of the mold 5, such as to form cylinders in the ultimate cast metal part. In applications such as engines or manifolds, it is imperative to maintain proper wall thickness to manage stress in the part during use. If the mold cores 5 and 6 can not be properly aligned, the part would require heavier, and hence more costly, wall thicknesses.

Traditionally, the mold parts, called cores, are positioned with respect to one another with holes through which clamping bolts, may pass. This represents, however, an overconstrained system, and only tolerances on the order of a few mm are best achievable. The method of indentable kinematic couplings of the invention, on the other hand, admirably achieves higher tolerances. In FIG. 1, therefore, each part 5 and 6 has a V-shaped groove 10*a* and 10*a*'(more particularly visible in the side sections of FIG. 2*a* at 30*a* and 30*a*') and through-holes 12*a* and 12*a*', respectively. In fact, sets of three such grooves are arranged typically so that they are aligned to bisect the angles of the triangle formed by connecting the centers of each of the three grooves. When hard balls are placed in each of the groove pairs, such as ball 11*a*, and the balls are located axially in the grooves, such as by a tie-rod 20*a*, later more described, one part 5 will be uniquely and precisely positioned with respect to the other part 6. If the parts are made where the grooves have the same alignment within a degree or so, any axial motion of the balls in the grooves will result in a second order position error, so that the tolerance of the hole in the ball and the tie-rod that passes through it can be on the order of a mm.

Nuts, such as 21*a* and 21*b*, FIG. 1 (in addition a third nut not shown), are then tightened, causing the balls in the grooves, such as the ball 1 la in the grooves 10*a* and 10*a*', to indent the material in the grooves. The balls will continue to indent until the mating faces of the cores translate together to form a flat face planar contact seal joint 9. Metal or even wooden balls can serve to indent into a sand core. One may also use metal or other hard balls which are retrieved and used again after the casting process is complete and the sand is shaken off the part. As the balls indent into the soft material of the grooves, the parts move in the Z direction, while still maintaining alignment in the XY plane.

Figure 2A:
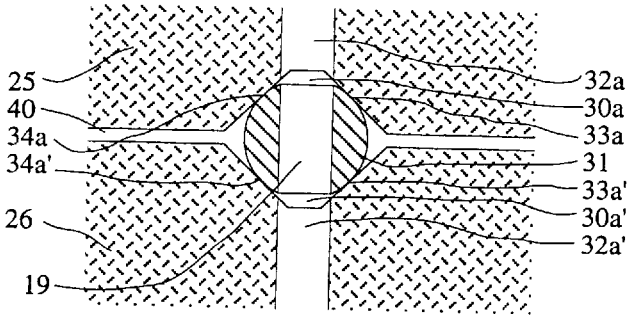
Figure 2B:
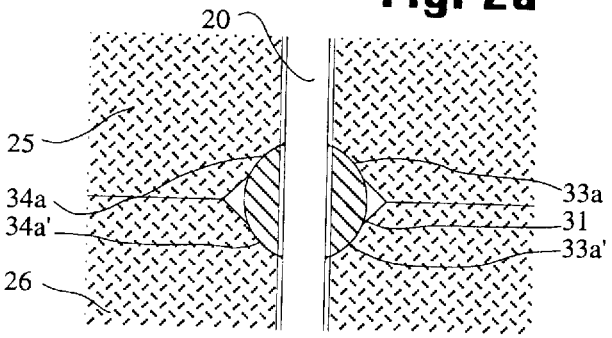

FIGS. 2*a* and 2*b* show this process in greater detail, wherein parts 25 and 26 have been provided with respective V-shaped grooves 30*a* and 30*a* 'that are aligned when a ball 31 is placed in the grooves. When the ball is first placed in the grooves, and the weight of part 25 rests on the ball, it is not enough fully to indent the ball into the grooves, so a gap 40 exists between the parts, FIG. 2*a*. After a tie-rod 20 is passed through the holes 32*a*, 32*a*', and a central hole in the ball at 19 and tightened, the ball 31 indents into the grooves at four points 33*a*, 33*a*', 34*a*, and 34*a*', FIG. 2*b*. The ball indents the grooves because the contact stresses are high, and the grooves are soft and the ball is hard.

In the converse situation, moreover, of hard molds, such as metal molds, hard grooves may be used with soft balls, as of rubber, plastic, or wax or other soft material, and they would burn-off from the heat of the casting.

Figure 3:
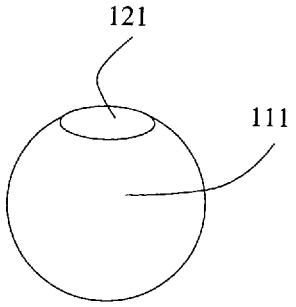

FIG. 3 shows a ball 111 with a preformed hole 121 for placement in the grooves. It should be noted that there are many different configurations possible, such as a tie rod with an integral spherical lobe in its center, and such design derivations are considered within the scope of this invention.

Figure 4:
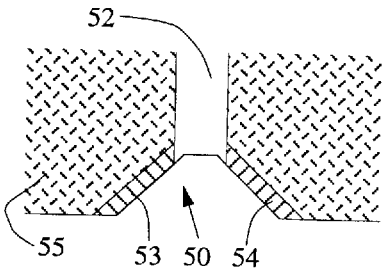
FIG. 4 is cutaway side view of a groove in a part, where the groove is lined with a soft indentable surface material.

There may also be instances where the mold cores are too hard for indentation, or they are of sand-binder mixes that do not indent uniformly, yet they are still too soft for the use of a soft ball. In this case, the groove surfaces can have soft foam inserts as shown in FIG. 4, which can serve as tuned compression zones for the balls to contact with the grooves. The part 55, for example, has a groove 50 with soft foam inserts 53 and 54. The hole 52 is still used to receive a tie-rod.

In the embodiments shown where a tie rod is passed through the centers of the balls, such operation acts to center the balls in the grooves and to provide the clamping force that indents the balls into the grooves, causing the mold cores to translate and come together in intimate planar contact, while maintaining precise kinematic location and alignment until contact. With this method, moreover, many mold cores can be stacked upon one other to create a very complex, yet extremely accurate, mold for casting. Other clamping means such as a presses or the like may also be used, if desired.

Figure 5:
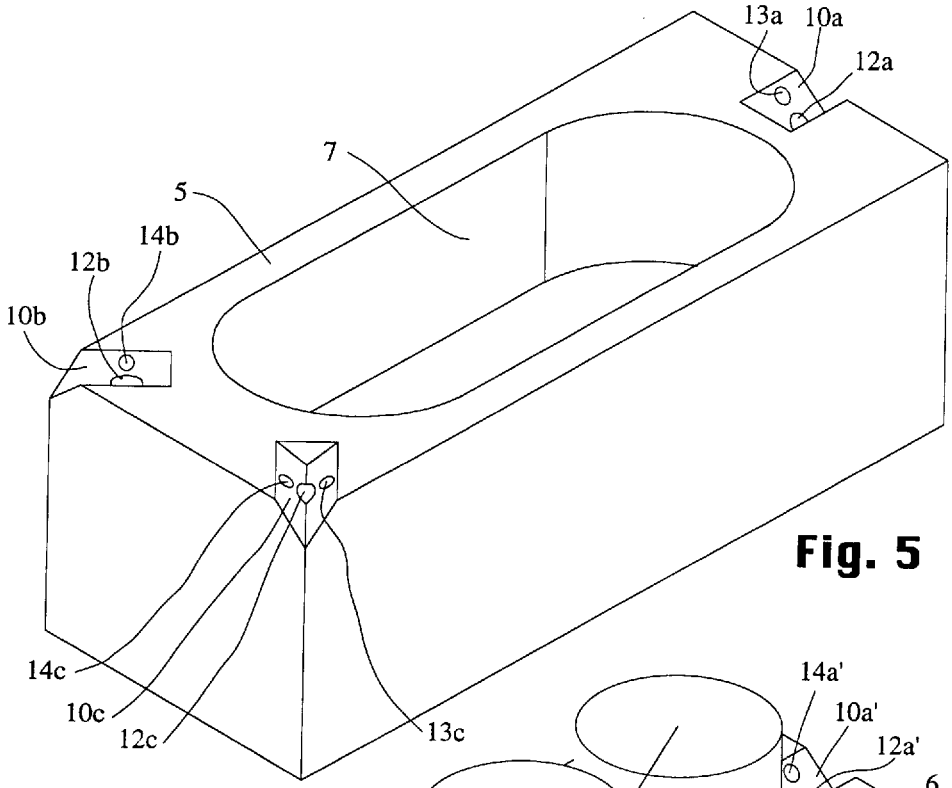
FIG. 5 is an isometric view of the upper half of the mold assembly shown in FIG. 1.

FIG. 5 shows the upper half 5 of the mold shown in FIG. 1. Here, the central cavity 7 is formed by packing sand around a pattern as is well known in the art. The pattern may be made, for example, from machined wood or aluminum, and can be used to make many many cores. The pattern is precisely machined, so at the same time the form for cavity 7 is made, precisely located grooves 10*a*, 10*b*, and 10*c* and tie-rod pass-through holes 12*a*, 12*b*, and 12*c* may also be formed. The indentation zones 13*a*, 14*b*, and 13*c*, 14*c* are also shown in the grooves 10*a*, 10*b*, and 10*c* in FIG. 5.

Figure 6:
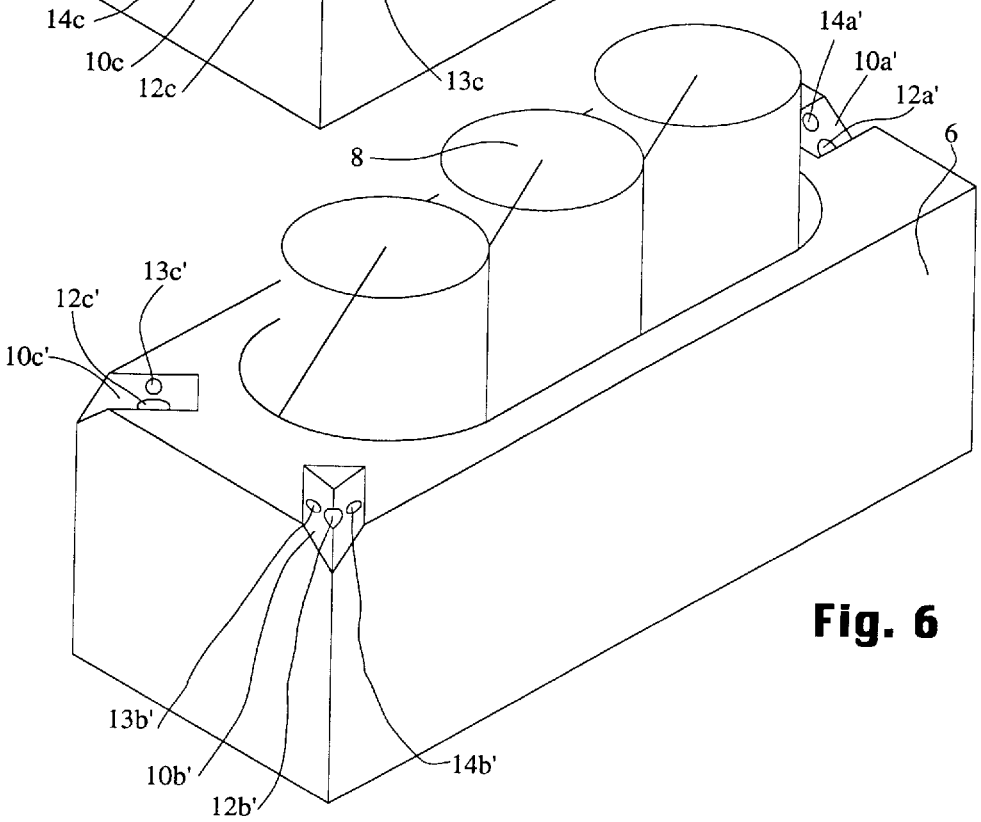
FIG. 6 is an isometric view of the lower half of the mold assembly of FIG. 1.

FIG. 6 illustrates the other half of the mold core 6 with its central cylindrical cores 8 that project into the cavity 7 of core 5. Core 6 also has corresponding kinematic location grooves 10*a*', 10*b*', and 10*c* 'and tie-rod pass-through holes 12*a*', 12*b*', and 12*c* 'that are formed at the same time as the core 8, using a precisely machined pattern. Similarly, the indentation zones 13*a*', 14*b*', and 13*c*', 14*c*', formed by the balls that would be placed between the corresponding grooves in the two cores, are illustrated in FIG. 6.

Further modifications of the invention will also occur to persons skilled in the art, and all such are deemed to fall within the spirit and scope of the invention as defined in the appended claims.

What is claimed is:

1. A method of kinematically coupling and clamping together a pair of opposing mold cores, that comprises, forming opposing sets of grooves in each core, inserting ball elements between corresponding grooves of the cores, the grooves and the ball elements being of significantly different relative hardness; and clamping the cores together to enable deformations at the ball-groove interfaces that cause the cores to translate and come together in intimate planar contact, while maintaining precise kinematic location until contact.

2. A method as claimed in claim 1 and in which the grooves in the cores are of relatively soft material and the ball elements of relatively hard material so that the deformations occur within the grooves.

3. A method as claimed in claim 1 and in which the grooves in the cores are of relatively hard material and the ball elements of relatively soft material so that the deformations occur within the ball elements.

4. A method as claimed in claim 2 and in which the grooves are of substantially V-shape with a ball element making two points of contact within each groove.

5. A method as claimed in claim 4 and in which pass-through holes are provided through the centers of the grooves and through the centers of said ball elements, and a tie rod is passed through these holes to assist in locating the ball element in the grooves and to enable a clamping force to be exerted to create said deformations and cause translation motion to occur to bring the cores into intimate planar contact.

6. A method as claimed in claim 2 and in which soft deformable inserts are provided in the grooves for contact with the ball elements.

7. A method of kinematically coupling and clamping together a pair of opposing objects, that comprises, forming opposing sets of grooves in each object; inserting ball elements between corresponding grooves of the objects, the grooves and the ball elements being of significantly different relative hardness; and clamping the objects together to enable deformations at the ball-groove interfaces that cause the objects to translate and come together in intimate planar contact, while maintaining precise kinematic location until contact and in which the grooves in the objects are of relatively soft material and the ball elements of relatively hard material so that the deformations occur within the grooves and in which the objects comprise sand cores formed around a pattern to provide a mold for the precise casting of parts.

8. A method as claimed in claim 7 and in which the parts cast in the mold are cast metal engine parts.

9. A system for kinematically coupling and claming together a pair of opposing cores, having, in combination, opposing sets of grooves formed in each core, ball elements inserted between corresponding grooves of the cores, the grooves and the ball elements being of significantly different relative hardness; and means for clamping together to enable deformations at the ball-groove interfaces that cause the cores to translate and come together in intimate planar contact, while maintaining precise kinematic location until contact.

10. A system as claimed in claim 9 and in which the grooves in the cores are of relatively soft material and the ball elements of relatively hard material so that the deformations occur within the grooves.

11. A system as claimed in claim 9 and in which the grooves in the cores are of relatively hard material and the ball elements of relatively soft material so that the deformations occur within the ball elements.

12. A system as claimed in claim 10 and in which the grooves are of substantially V-shape with a ball element making two points of contact within each groove.

13. A system as claimed in claim 12 and in which pass-through holes are provided through the centers of the grooves and through the centers of said ball elements, and a tie rod passed through these holes to assist in locating the ball elements in the grooves and to enable a clamping force to be exerted to create said deformations and cause translation motion to occur to bring the cores into intimate planar contact.

14. A system as claimed in claim 10 and in which soft deformable inserts are provided in the grooves for contact with the ball elements.

15. A system for kinematically coupling and clamping together a pair of opposing objects, having, in combination, opposing sets of grooves formed in each object; ball elements inserted between corresponding grooves of the objects, the grooves and the ball elements begin of significantly different relative hardness; and means for clamping the objects together to enable deformations at the ball-groove interfaces that cause the objects to translate and come together in intimate planar contact, while maintaining precise kinematic location until contact and in which the grooves in the objects are of relatively soft material and the ball elements of relatively hard material so that the deformations occur within the grooves and in which the objects comprise sand cores formed around a pattern to provide a mold for the precise casting of parts.

16. A system as claimed in claim 15 and in which the mold is adapted to cast metal engine parts.

17. A system as claim 10 and in which each core is provided with a set of three spaced grooves and corresponding ball elements.

18. A system for positioning and aligning two or more mold cores with respect to one other to define all six degrees of freedom between the cores, wherein each core has formed in it three V-shaped grooves that align and face each other, and between each pair of facing grooves is a disposed ball that makes two points of contact with each groove, such that the cores may be kinematically positioned with respect to each other, but spaced apart and means for applying force to cause deformation at the ball-groove interfaces to cause the cores to translate with respect to each other and to cause them to come into contact with each other, thereby forming a plane of contact.

* * * * *